US005934568A

United States Patent [19]

Brown

[11] Patent Number: 5,934,568

[45] Date of Patent: Aug. 10, 1999

[54] NOZZLE APPARATUS FOR DELIVERING FIRE RETARDANT FOAM

[76] Inventor: C. Coy Brown, 323 Florida SE., Albuguerque, N.Mex. 87108

[21] Appl. No.: 09/008,464

[22] Filed: Jan. 16, 1998

[51] Int. Cl.[6] ..... B05B 7/06

[52] U.S. Cl. ..... 239/428.5; 239/419.5; 239/425.5; 239/429; 169/15

[58] Field of Search ..... 239/419.5, 425.5, 239/428.5, 429; 169/15

[56] References Cited

U.S. PATENT DOCUMENTS

| | | | |
|---|---|---|---|
| 3,388,868 | 6/1968 | Watson et al. | 239/428.5 X |
| 4,219,159 | 8/1980 | Wesner | 239/428.5 X |
| 5,085,371 | 2/1992 | Paige | 239/428.5 X |
| 5,275,763 | 1/1994 | Fukai | 169/15 X |
| 5,382,389 | 1/1995 | Goodine et al. | 169/15 X |
| 5,417,371 | 5/1995 | Brackett | 239/428.5 X |

FOREIGN PATENT DOCUMENTS

| | | | |
|---|---|---|---|
| 936492 | 11/1955 | Germany | 169/15 |

*Primary Examiner*—Andres Kashnikow
*Assistant Examiner*—Robin O. Evans
*Attorney, Agent, or Firm*—Harrison & Egbert

[57] ABSTRACT

A nozzle apparatus for delivering a fire-retardant foam including a fluid delivery member having an interior passage of a given diameter, an expansion tube connected to the fluid delivery member, an agitator positioned within an interior passageway of the expansion tube and an aspiration port formed in the expansion tube. The interior passage of the fluid delivery member extends to a tapered region having a outlet orifice at a narrow end of the tapered region. The interior passage is connected to a wide end of the tapered region. The aspirator port is positioned between the outlet orifice and the agitator. The expansion tube has an interior passageway extending to an outlet opening opposite the fluid delivery member. The outlet orifice opens to the interior passageway of the expansion tube. The interior passageway has a greater diameter than a diameter of the outlet orifice. The agitator is positioned within the expansion tube so as to turbulently mix the solution with air within the interior passageway. The aspirator port allows air to enter the interior passageway of the expansion tube as the solution passes through the interior passageway of the expansion tube.

14 Claims, 2 Drawing Sheets

FIG. 3
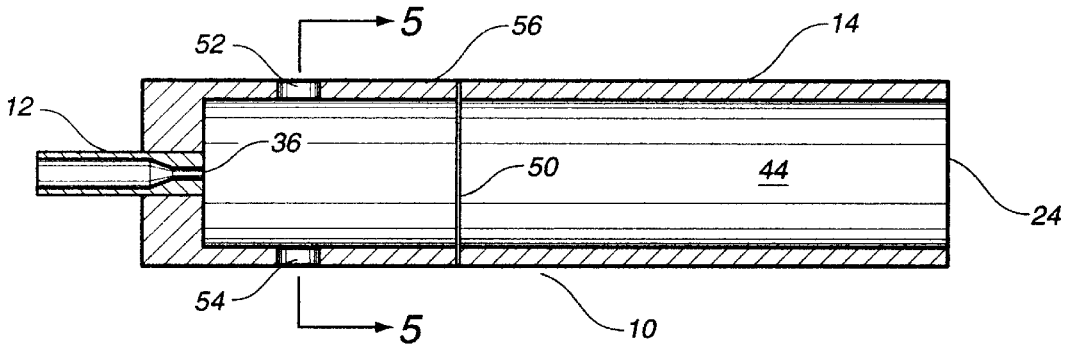
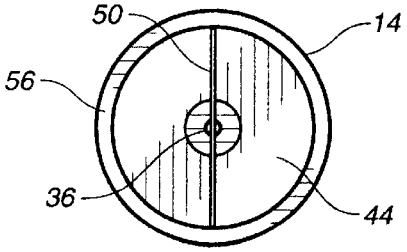
FIG. 4
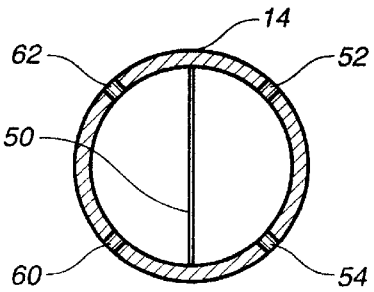
FIG. 5
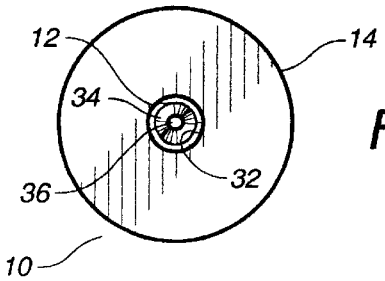
FIG. 6

NOZZLE APPARATUS FOR DELIVERING FIRE RETARDANT FOAM

TECHNICAL FIELD

The present invention relates generally to nozzle devices. More particularly, the present invention relates to nozzles as used for fire prevention and fire extinguishing equipment. Furthermore, the present invention relates to nozzles used for the delivery of fire retardant foam to a source of fire.

BACKGROUND ART

Current methods of fighting wildland and interface fires from the ground leave a significant gap in options available to fire fighters. On the low end of the gap, only fire fighters on foot are available. This option, by its nature, restricts fire fighting effectiveness to the limits of what individuals can accomplish without the benefit of mechanized aid. Personnel on foot are limited in distances they can travel and fire fighting equipment that can be carried to places where they are needed. Additionally, crews are essentially restricted to clearing fire lanes or setting "back" fires in an attempt to contain the fire. Either of these methods require surrendering significant amounts of area to the fire in order to provide enough time to make the fire break.

In general, there are major problems associated with fire fighting by personnel afoot. First, there is a very slow response time by such personnel. It often takes a great deal of time to reach the trouble area by foot. The safety of the personnel is an important concern. When such personnel are on foot, they are relatively unprotected and are often unable to leave the danger area promptly. The only fire fighting equipment that is available to such personnel afoot is fire fighting equipment that can be carried by the personnel. It is difficult to resupply the personnel in such inaccessible areas. In order to effectively fight the fire, a very high level of manpower is required. When the personnel are afoot, there is no structure to protect the personnel.

At the high end of the gap is the use of conventional pumper type vehicles which carry water, hoses, and pumps for fire fighting. The smallest of these vehicles use Ford Ranger size four wheel drive chassis equipped with tanks, pumps, and standard structure fire fighting equipment These units are limited to a maximum of about 120 gallons of water onboard and require two persons to operate. Although the vehicles are off-road capable, they are relatively restricted in the area they can readily access. In rougher terrains, the vehicle speeds are greatly reduced and they are too large to enter much of the wildland growth density. Another problem is that the vehicle must (or should) be stopped when pumping water. Few of these vehicles are equipped to dispense foam. Those that do have foam capabilities are field retrofitted by whomever and perform with dubious, inconsistent results. Obviously, larger pumpers are almost entirely relegated to improved roads, require more personnel to operate, and cannot enter unknown small roads for fear of inability to turn around and exit the area. Application for this type of equipment is principally for fire fighting structure fires in relatively accessible areas with ample water supplies.

The present inventor developed a device for structure protection and fighting small fires in remote locations. This device is described in U.S. Pat. No. 5,476,146, issued on Dec. 19, 1995. This fire fighting apparatus includes a vehicle, a first fluid tank supported on the vehicle, a second fluid tank supported on the vehicle at a different location than the first fluid tank, a pipe connecting the first fluid tank to the second fluid tank so as to cause a flow of liquid between the tanks, a conduit extending from the tanks for passing the liquid in the tanks exterior of the vehicle, and a pump connected to the conduit for passing the liquid under pressure through the conduit. The device includes a foam concentrate tank connected to the conduit and positioned on the vehicle generally adjacent one of the tanks. The foam concentrate tank has a line extending to and communicating with the conduit. The conduit includes a first hose extending from the conduit and connected to a spray boom and a second hose extending from the conduit and connected to a spray gun.

During the development of the device of U.S. Pat. No. 5,476,146, it was found that there were no foam nozzles on the market that would project a spray of fire retardant foam an acceptable distance. In general, the pressure available from the pump on the device proved insufficient to adequately project the foam to the source of fire. It was found that if it became impossible to adequately project the foam a satisfactory distance, then the utility of the device of U.S. Pat. No. 5,476,146 would be greatly impaired. As such, a need developed so as to enhance the ability to project the foam mixture to a desired location at least 40 feet away from the vehicle.

As used herein, the term "foam" refers to the mixture of foam concentrate, water and air. The term "solution" refers to the mixture of foam concentrate (or foaming agent) and water. The "solution" is delivered to the nozzle apparatus. The "foam" is expelled from the outlet of the nozzle apparatus after the "solution" mixes with air.

Given the constraints of the all-terrain vehicle and the size of the equipment used, it was discovered that it would be difficult or impossible to incorporate larger pumping apparatus. As such, the pressure that was available from the pumping apparatus which could be used on the device would be insufficient to properly project the foam with existing nozzles and current nozzle designs. As such, experiments were conducted and a nozzle designed and tested such that it performed to acceptable levels and which made the vehicle viable for its intended purpose.

It is an object of the present invention to provide a nozzle apparatus that allows for the delivery of foam more than 40 feet away from the nozzle.

It is another object of the present invention to provide a nozzle apparatus which can project foam at relatively low pressures and at low volumes.

It is another object of the present invention to provide a nozzle apparatus which can deliver foam without the introduction of compressed air and its associated equipment.

It is still a further object of the present invention to provide a nozzle apparatus which enhances the mixing of the solution with air during delivery.

It is another object of the present invention to provide a nozzle apparatus which is easy to use, relatively inexpensive, and easy to manufacture.

These and other objects and advantages of the present invention will become apparent from a reading of the attached specification and appended claims.

SUMMARY OF THE INVENTION

The present invention is a nozzle apparatus for delivering fire retardant foam to a desired location. This nozzle apparatus comprises a fluid delivery member having an interior passage of a given diameter, an expansion tube connected to the fluid delivery member, an agitator positioned within the interior passageway of the expansion tube, and an aspirator port formed in the expansion tube. The interior passage of the fluid delivery member extends to a tapered region. This tapered region has an outlet orifice at a narrow end of the tapered region. The interior passage is connected to a wide end of the tapered region. The expansion tube has an interior passageway extending to an outlet opening opposite the fluid delivery member. The outlet orifice opens to the interior passageway of the expansion tube. This interior passageway has a greater diameter than a diameter of the outlet orifice. The agitator serves to turbulently mix the solution with aspirated air within the interior passageway of the expansion tube. The aspirator port is formed in the expansion tube between the outlet orifice and the agitator. The aspirator port allows air to enter the interior passageway of the expansion tube as the solution passes through this interior passageway.

The fluid delivery member has means thereon for connection to a source of the pressurized solution. The interior passage of the fluid delivery member has a length at least four times the given diameter of the interior passage. The wide end of the tapered region has a diameter equal to the given diameter of the interior passage of the fluid delivery member. The tapered region tapers inwardly from the wide end toward the narrow end at a generally 4:1 ratio of length to diameter.

The outlet orifice has a diameter not more than one-half of the given diameter of the interior passage of the fluid delivery member. The outlet orifice has a constant diameter length extending from the narrow end of the tapered region. Specifically, the outlet orifice has a length no more than three times the diameter of the outlet orifice.

The agitator is a wire which extends across the interior passageway of the expansion tube generally transverse to a longitudinal axis of the expansion tube. The wire has a diameter of between ¼ and ½ of the diameter of the outlet orifice.

The aspirator port is formed through the wall of the expansion tube. The aspirator port opens to the interior passageway of the expansion tube.

A fluid delivery member is connected to the fluid delivery means so as to pass the solution under pressure into an inlet of the fluid delivery member. The fluid delivery means serves to pass the solution at less than 140 p.s.i.

BRIEF DESCRIPTION OF THE DRAWINGS

FIG. 3 is a cross-sectional view showing the configuration of the expansion tube, agitator and aspiration ports of the present invention.

FIG. 4 is an right side end view of the apparatus as shown in FIG. 3.

FIG. 5 is a cross-sectional view taken across lines 5—5 of FIG. 3.

FIG. 6 is a left side end view of the apparatus as shown in FIG. 2.

DETAILED DESCRIPTION OF THE INVENTION

Figure 1:
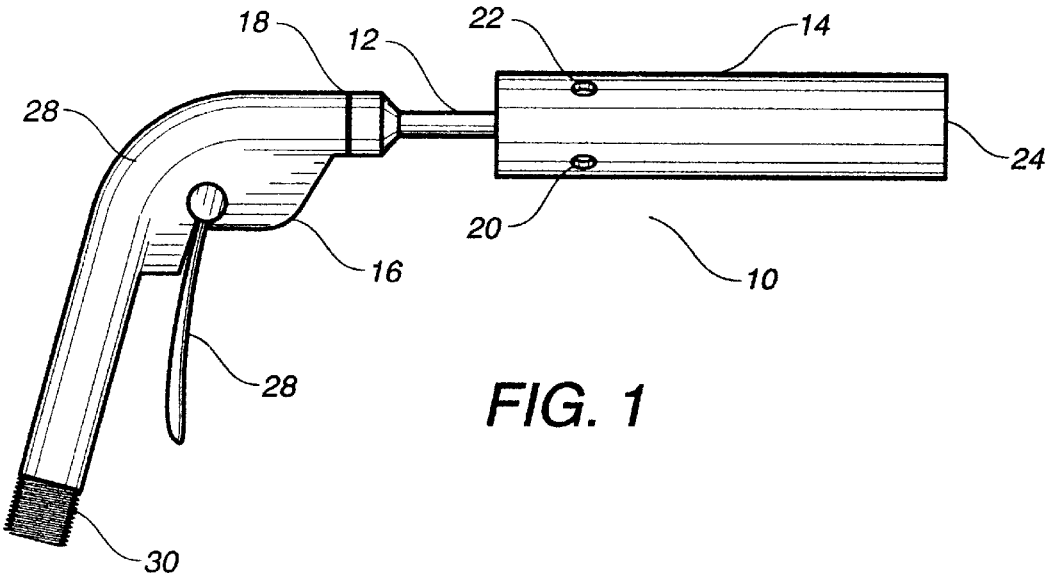
FIG. 1 is a side elevational view of the nozzle apparatus of the present invention.

In FIG. 1, there is shown at 10 the nozzle apparatus in accordance with the teachings of the present invention. The nozzle apparatus 10 includes a fluid delivery member 12 and an expansion tube 14. The fluid delivery member 12 is connected to a source 16 of the solution. As illustrated in FIG. 1, the source 16 can be a hose, a sprayer, or a pump connected to the fluid delivery member 12. The fluid delivery member 12 has its inlet connected to the end 18 of the source 16. The expansion tube 14 is connected to the opposite end of the fluid delivery member 12. Aspiration ports 20 and 22 are shown as formed on the expansion tube 14 so as to allow air to pass into an interior passageway of the expansion tube 14. The solution is delivered outwardly of the expansion tube at outlet opening 24.

As can be seen in FIG. 1, the source 16 includes a body 26 in the form of a common garden hose sprayer. A trigger 28 is connected to body 26. A hose connector 30 is formed at one end of the body 26 so as to allow for the connection of the body 26 to the supply of the solution. The solution is delivered, simultaneously, into the interior of the body 26 and outwardly therefrom through end 18 into the fluid delivery member 12.

Under the teachings of the present invention, the present invention allows the foaming to be delivered to distances of greater than 40 feet even though the mixture is passed to the nozzle apparatus 10 under less than 140 p.s.i. of pressure. Additionally, the foam can be suitably delivered even though the volume of the solution being delivered to the nozzle apparatus 10 is less than ten gallons per minute. As such, the nozzle apparatus 10 allows the foam to be delivered to a remote location without the need for high pressure pumps and other high pressure equipment. It is through the unique arrangement of the fluid delivery member 12 and the expansion tube 14 that the foam can be delivered over such long distances.

Figure 2:
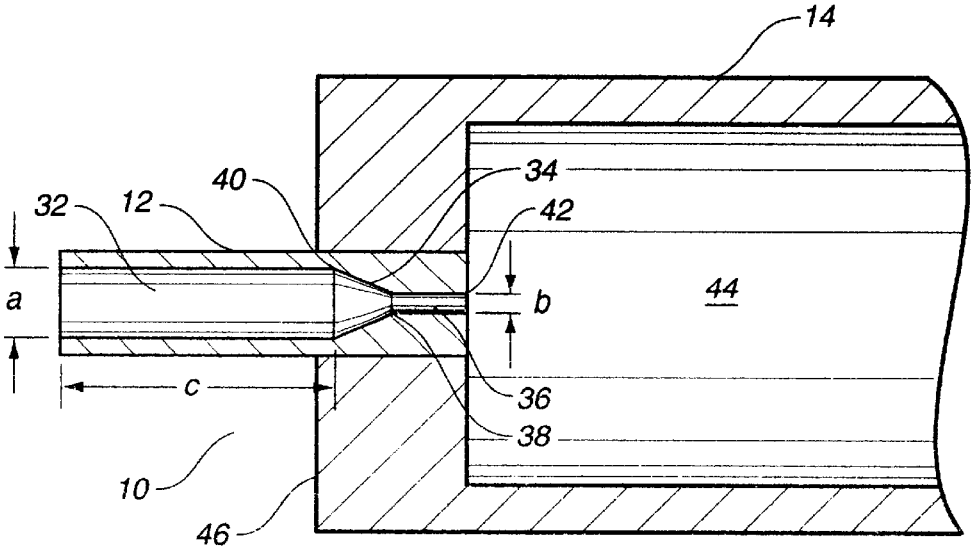
FIG. 2 is a cross-sectional view showing the connection of the fluid delivery member with the expansion tube.

FIG. 2 shows the manner in which the fluid delivery member 12 is connected to the expansion tube 14 in the nozzle apparatus 10 of the present invention. As can be seen in FIG. 2, the fluid delivery member 12 has an interior passage 32 of a given diameter a. The interior passage 32 extends through the fluid delivery member 12 to a tapered region 34. The tapered region 34 has an outlet orifice 36 at the narrow end 38 of the tapered region 34. The interior passage 32 is connected to the wide end 40 of the tapered region 34.

In the preferred embodiment of the present invention, the tapered region 34 is formed in the body of the fluid delivery member 12 at the end of the interior passage 32. The wide end 40 of the tapered region 34 has a diameter matching the diameter a of the interior passage 32. The narrow end 38 of the tapered region 34 is connected to the outlet orifice 36. The outlet orifice 36 has a diameter b not more than ½ of the diameter a of the interior passage 32 of the fluid delivery member 12. The outlet orifice 36 has a constant diameter length extending from the narrow end 38 of the tapered region 34 to an outlet end 42. The length of the outlet orifice 36 is no more than three times the diameter b. The tapered region 34 tapers inwardly from the wide end 40 to the narrow end 38 at generally a 4:1 ratio of length to diameter. In other words, for every four inches of length, the diameter of the tapered region 34 will be reduced by one inch. The interior passage 32 has a length c which is at least four times the diameter a of the interior passage 32. The relationship of diameters and length is necessary so that the solution can suitably mix, and be straightened, within the interior passage 32 prior to being delivered into the interior passageway 44 of the expansion tube 14. Experiments with various sizes, shapes, dimensions, and ratios of the fluid delivery member 12 have indicated that this relationship of sizes, ratios, and diameters will assure the optimal delivery of the solution into the interior passageway 44 of the expansion tube 14.

As can be seen in FIG. 2, the expansion tube 14 is connected at end 46 over the fluid delivery member 12. The expansion tube 14 will be securely and fixedly mounted onto the exterior surface of the fluid delivery member 12. The expansion tube 14 has its interior passageway 44 extending to the outlet opening 24 opposite the fluid delivery member 12. The outlet orifice 36 opens to the interior passageway 44 of the expansion tube 14. Interior passageway 44 of the expansion tube 14 has a diameter greater than the diameter b of the outlet orifice 36.

FIG. 3 shows the entire expansion tube 14. It can be seen that the expansion tube 14 has outlet opening 24 opposite to the fluid delivery member 12. Importantly, an agitator member 50 is positioned within the interior passageway 44 so as to turbulently mix the solution with air within the interior passageway 44 prior to being expelled as foam out of the outlet opening 24. The agitator 50 is a wire or an equivalent means which extends across the interior passageway 44 generally transverse to the longitudinal axis of the expansion tube 14. In the preferred embodiment of the present invention, the wire will have a diameter of between ¼ and ½ of the diameter of the outlet orifice 36. In the preferred embodiment of the present invention, the diameter of the agitator will be between 0.05 inches and 0.125 inches. It is important to note that there are alternative approaches to the use of the wire as the agitator 50. For example, teardrop-shaped diverter member can be used, a ribbon can extend thereacross, a V-shaped deflector, or various other devices can be used.

It can be seen in FIG. 3 that an aspiration port 52 and an aspiration port 54 are formed through the wall 56 of the expansion tube 14. The aspiration ports 52 and 54 are positioned between the agitator 50 and the outlet orifice 36 of the fluid delivery member 12. Each of the aspirator ports 52 and 54 will allow air to pass into the interior passageway 44 as the solution is delivered through the interior passageway 44.

In general, the aspiration ports 52 and 54 will be positioned between the agitator 50 and the outlet orifice 36. Specifically, following experiments with the present invention, it was found, in the preferred embodiment, that the aspiration ports 52 and 54 should be positioned between one inch and 1½ inches from the outlet orifice 36. The agitator 50 should be positioned approximately two inches from the aspiration ports 52 and 54. In larger applications and with greater flow rates, the aspiration ports positioned approximately a distance of twice an inside diameter of the expansion tube 14 from the outlet orifice 36. The agitator 50 would be positioned approximately three times the inside diameter of the expansion tube 14 from the ports 52 and 54.

FIG. 4 shows how the agitator 50 extends transversely and radially across the interior passageway 44 of the expansion tube 14. The outlet orifice 36 is positioned directly behind the agitator 50. As the solution is emitted by the outlet orifice 36, the agitator 50 will cause the solution to turbulently mix with air within the interior passageway 44. Specifically, the agitator 50 will divide the flow of the solution into angularly directed streams. These streams will tend to "bounce" back and forth off of the walls of the expansion tube 14. This causes a very violent and turbulent mixing of the solution and air.

FIG. 5 shows the arrangement of the ports 52 and 54 of the present invention. In the preferred embodiment of the present invention, it was found that four ports 52, 54, 60 and 62 should be formed in the expansion tube 14. Each of these ports 52, 54, 60 and 62 are spaced proportionately from each other. The aspirator ports 52, 54, 60 and 62 allow air to enter the solution and to be pulled therein as the solution flows through the interior passageway 44. The movement of the solution through the interior passageway 44 will create a suction so as to pull the air through the aspiration ports. This suction will entrain the air in the water droplets so as to create more suction. As such, air will be intermixed with the solution without the need for a source of compressed air. The arrangement of the four ports, as shown in FIG. 5, creates an equalization on the vacuum pulled in by the flow of the solution through the interior passageway 44. The introduction of air through the aspiration ports 52, 54, 60 and 62 further enhances the mixing and agitation of the solution with air within the interior passageway 44 of expansion tube 14.

FIG. 6 shows an end view of the nozzle apparatus 10. As can be seen, the fluid delivery member 12 is connected to one end of the expansion tube 14. The outlet orifice 36 is shown as centered at the end of the tapered region 34. The interior passage 32 of the fluid delivery member 12 and the interior passageway 44 of the expansion tube 14 will be coaxial.

The present invention unexpectedly allows for the delivery of foam to remote locations. An unexpected advantage of the present invention is that the delivery of this foam can be achieved with almost no recoil effect. Experiments have indicated that if the agitator 50 is removed, then the recoil effect can be felt. It is believed that the nozzle apparatus of the present invention could be used by fireman so as to minimize the recoil effect caused by the delivery of water thorough the fire hose.

The apparatus 10 of the present invention can be suitably scaled up, if necessary, so as to project the mixtures to 100 feet or more with a fluid flow of ten gallons per minute. The foaming agent which is desired to be used with the present invention is called a Class "A" Range foam. Experiments with the present invention show that, with relatively low pressure and flow rates, the foam can be projected more than 45 feet. As such, the nozzle apparatus 10 of the present invention can be utilized with the all-terrain vehicle of U.S. Pat. No. 5,476,146 or with other fire extinguishing vehicles and apparatus. As such, effective fire extinguishing techniques can be utilized even without high pressure equipment or high volumes of fluid flow.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A nozzle apparatus for delivering a fire retardant foam comprising:

a fluid delivery member having an interior passage of a given diameter, said interior passage extending to a tapered region, said tapered region having a outlet orifice at a narrow end of said tapered region, said interior passageway connected to a wide end of said tapered region, said interior passage of said fluid delivery member having a length of at least four times said given diameter, said tapered region tapering inwardly from said wide end at a generally 4:1 ratio of length to diameter, said outlet orifice having a diameter not more than one-half of said given diameter of said interior passage of said fluid delivery member;

an expansion tube connected to said fluid delivery member, said expansion tube having an interior passageway extending to an outlet opening opposite said fluid delivery member, said outlet orifice opening to said interior passageway of said expansion tube, said interior passageway having a greater diameter than a diameter of said outlet orifice;

an agitator means positioned within said interior passageway of said expansion tube, said agitator means for turbulently mixing a solution with air within said interior passageway of said expansion tube; and an aspiration means formed in said expansion tube between said outlet orifice and said agitator means, said aspiration means for causing the air to enter said interior passageway of said expansion tube as the solution passes through said interior passageway of said expansion tube.

2. The apparatus of claim 1, said fluid delivery member having means thereon for connection to a pressurized source of the solution.

3. The apparatus of claim 1, said aspiration means comprising at least one port formed through a wall of said expansion tube, said port opening to said interior passageway of said expansion tube.

4. The apparatus of claim 1, said wide end of said tapered region having a diameter equal to said given diameter of said interior passage of said fluid delivery member.

5. The apparatus of claim 1, further comprising:

fluid delivery means connected to said fluid delivery member, said fluid delivery means for passing the solution under pressure into an inlet of said fluid delivery member.

6. The apparatus of claim 1, said interior passage of said fluid delivery member being coaxial with said interior passageway of said expansion tube.

7. The apparatus of claim 1, said outlet orifice having a constant diameter length extending from said narrow end of said tapered region.

8. The apparatus of claim 7, said outlet orifice having a length no more than three times the diameter of said outlet orifice.

9. A nozzle apparatus for delivering a fire retardant foam comprising:

a fluid deliver member having an interior passage of a given diameter, said interior passage extending to a tapered region, said tapered region having a outlet orifice at a narrow end of said tapered region, said interior passageway connected to a wide end of said tapered region;

an expansion tube connected to said fluid delivery member, said expansion tube having an interior passageway extending to an outlet opening opposite said fluid delivery member, said outlet orifice opening to said interior passageway of said expansion tube, said interior passageway having a greater diameter than a diameter of said outlet orifice;

an agitator means positioned within said interior passageway of said expansion tube, said agitator means for turbulently mixing a solution with air within said interior passageway of said expansion tube; and an aspiration means formed in said expansion tube between said outlet orifice and said agitator means, said aspiration means for causing the air to enter said interior passageway of said expansion tube as the solution passes through said interior passageway of said expansion tube, said agitator means comprising a single wire extending across said interior passageway of said expansion tube generally transverse to a longitudinal axis of said expansion tube.

10. The apparatus of claim 9, said wire having a diameter of between ¼ to ½ of the diameter of said outlet orifice.

11. A nozzle apparatus for delivering a fire retardant foam comprising:

a fluid delivery member having an interior passage of a given diameter, said interior passage extending to a tapered region, said tapered region having a outlet orifice at a narrow end of said tapered region, said interior passageway connected to a wide end of said tapered region;

an expansion tube connected to said fluid delivery member, said expansion tube having an interior passageway extending to an outlet opening opposite said fluid delivery member, said outlet orifice opening to said interior passageway of said expansion tube, said interior passageway having a greater diameter than a diameter of said outlet orifice;

an agitator means positioned within said interior passageway of said expansion tube, said agitator means for turbulently mixing a solution with air within said interior passageway of said expansion tube; and an aspiration means formed in said expansion tube between said outlet orifice and said agitator means, said aspiration means for causing the air to enter said interior passageway of said expansion tube as the solution passes through said interior passageway of said expansion tube, said aspiration means comprising multiple ports formed through a wall of said expansion tube, each of said multiple ports being proportionately spaced from an adjacent port, said agitator means comprising a wire extending as a crosshair across said interior passageway of said expansion tube.

12. The apparatus of claim 11, said fluid delivery means for passing the solution under a pressure of less than 140 p.s.i.

13. The apparatus of claim 11, said fluid delivery means for delivering the solution outwardly of said outlet orifice at a rate of less than three gallons per minute.

14. A nozzle apparatus for delivering a fire retardant foam comprising:

a fluid delivery member having an interior passage of a given diameter, said interior passage extending to a tapered region, said tapered region having a outlet orifice at a narrow end of said tapered region, said interior passageway connected to a wide end of said tapered region;

an expansion tube connected to said fluid delivery member, said expansion tube having an interior passageway extending to an outlet opening opposite said fluid delivery member, said outlet orifice opening to said interior passageway of said expansion tube, said interior passageway having a greater diameter than a diameter of said outlet orifice;

an agitator means positioned within said interior passageway of said expansion tube, said agitator means for turbulently mixing a solution with air within said interior passageway of said expansion tube; and an aspiration means formed in said expansion tube between said outlet orifice and said agitator means, said aspiration means for causing the air to enter said interior passageway of said expansion tube as the solution passes through said interior passageway of said expansion tube, said aspiration means comprising at least one port formed through a wall of said expansion tube, said port opening to said interior passageway of said expansion tube, said port being positioned approximately a distance of twice an inside diameter of said expansion tube from said outlet orifice, said agitator means being positioned approximately three times said inside diameter of said expansion tube from said port.

* * * * *